US005222813A

United States Patent [19]

Kopp et al.

[11] Patent Number: 5,222,813

[45] Date of Patent: Jun. 29, 1993

[54] PACKAGING BAG HAVING TEAR-OPEN MEANS

[75] Inventors: Georg Kopp, Uhwiesen; Willy Altermatt, Neuhausen am Rheinfall, both of Switzerland

[73] Assignee: SIG Schweizerische Industrie-Gesellschaft, Neuhausen am Rheinfall, Switzerland

[21] Appl. No.: 810,498

[22] Filed: Dec. 20, 1991

[30] Foreign Application Priority Data

Jan. 9, 1991 [CH] Switzerland ..... 40/91

[51] Int. Cl.[5] ..... B65D 30/10; B65D 65/30

[52] U.S. Cl. ..... 383/200; 229/87.05; 383/107

[58] Field of Search ..... 383/200, 107; 229/87.05

[56] References Cited

U.S. PATENT DOCUMENTS

| | | | |
|---|---|---|---|
| 684,181 | 10/1901 | Briery | 383/107 |
| 2,103,389 | 12/1937 | Salfisberg | 383/200 |
| 2,248,266 | 7/1941 | Abrams | 383/200 |
| 2,350,132 | 5/1944 | Rohdin | 383/107 |
| 2,496,753 | 2/1950 | Salfisberg | 383/107 |
| 2,542,206 | 2/1951 | Nichols | 383/200 |
| 2,851,212 | 9/1958 | Parmer . | |
| 2,923,404 | 2/1960 | Adell | 383/200 |
| 2,946,434 | 7/1960 | Brina | 383/200 |
| 3,164,695 | 1/1965 | Sanni | 383/200 |
| 3,809,220 | 5/1974 | Arcudi | 383/200 |
| 5,060,803 | 10/1991 | Beer et al. | 383/200 |

FOREIGN PATENT DOCUMENTS

| | | | |
|---|---|---|---|
| 2730132 | 11/1979 | Fed. Rep. of Germany . | |
| 2108379 | 5/1972 | France . | |
| 327556 | 3/1958 | Switzerland . | |
| 690614 | 5/1949 | United Kingdom | 383/200 |
| 1364300 | 8/1974 | United Kingdom | 383/200 |

*Primary Examiner*—Stephen P. Garbe

*Attorney, Agent, or Firm*—Spencer, Frank & Schneider

[57] ABSTRACT

A packaging bag made of sheet material includes a longitudinal seal situated at the longitudinal bag edge and extending parallel to the bag length. The longitudinal seal bonds together at least two layers of sheet material. The packaging bag further has two transverse seals extending parallel to the bag width and intersecting the longitudinal seal. Each transverse seal bonds together at least two layers of sheet material. A tear-open slit is provided in the longitudinal seal and passes through at least three layers of sheet material of the packaging bag.

12 Claims, 5 Drawing Sheets

Fig. 13
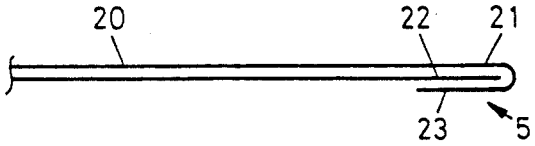
Fig. 14
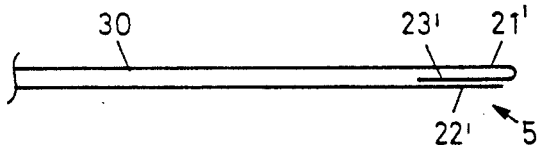
Fig. 15
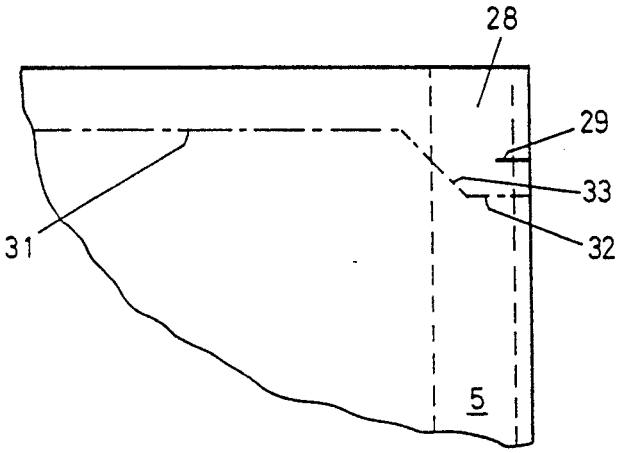
Fig. 16
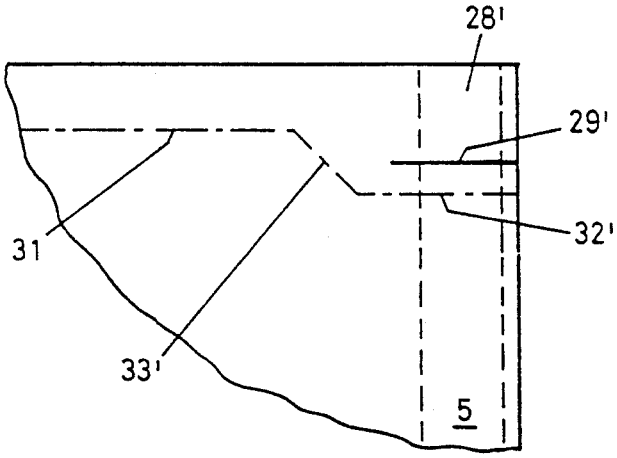
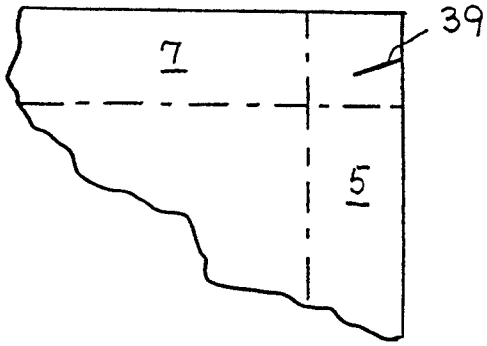
Fig. 17

PACKAGING BAG HAVING TEAR-OPEN MEANS

CROSS REFERENCE TO RELATED APPLICATION

This application claims the priority of Swiss Application No. 40/91-4 filed Jan. 9, 1991 which is incorporated herein by reference.

BACKGROUND OF THE INVENTION

This invention relates to a packaging bag which has a longitudinal seal and two transverse seals which traverse the longitudinal seal. The seals in the intersecting regions lie in different layers and further, there is provided a tear-open slit for aiding in initiating the tearing of the package. Such packaging bags are frequently used for food items. A tear-open aid which was found to be essential to be provided on such bags since otherwise difficulties are encountered to open the bag by hand, involve appreciable expense in the manufacture of the bags.

SUMMARY OF THE INVENTION

It is an object of the invention to provide an improved packaging bag in which the tear-open aid may be provided in a less expensive manner.

This object and others to become apparent as the specification progresses, are accomplished by the invention, according to which, briefly stated, the longitudinal seal extends at the edge of the bag and further, a tear-open slit is provided which is situated on the longitudinal seal and which cuts through at least three layers of the packaging bag.

BRIEF DESCRIPTION OF THE DRAWING

FIG. 13 is a sectional view of a further preferred embodiment having an "overlap" seal having an outwardly positioned strip.

FIG. 14 is a cross-sectional view of still another embodiment of the invention with an "overlap" seal having an inwardly oriented strip.

FIG. 15 is a top plan view of the embodiments shown in FIGS. 13 and 14, having a short tear-open slit.

FIG. 16 is a top plan view of the embodiments shown in FIGS. 13 and 14 having a long tear-open slit.

FIG. 17 is a top plan view of yet another embodiment of the invention showing a tear-open slit oriented obliquely to the bag length.

DESCRIPTION OF THE PREFERRED EMBODIMENTS

Figure 1:
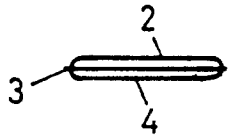
FIG. 1 is a schematic end elevational view of a packaging bag according to a first preferred embodiment of the invention, illustrated in a closed state.
Figure 2:
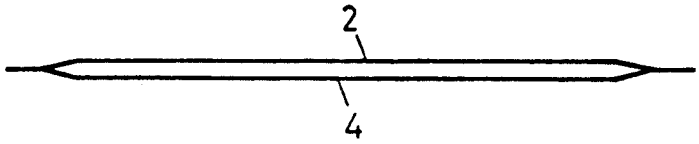
FIG. 2 is a side elevational view of the embodiment shown in FIG. 1.
Figure 3:
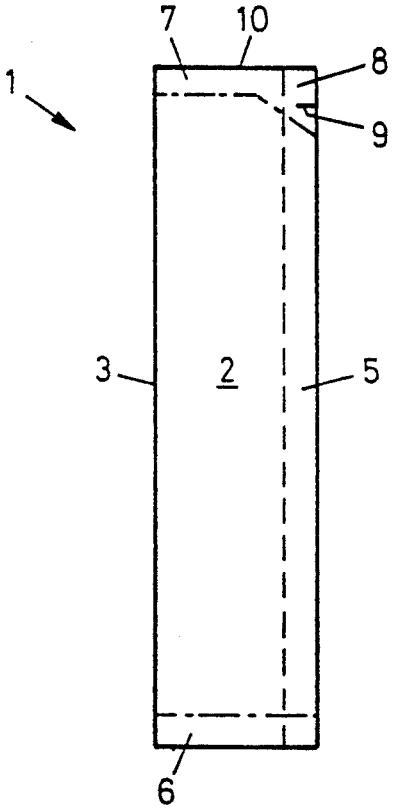
FIG. 3 is a top plan view cf the embodiment shown in FIG. 1.
Figure 4:
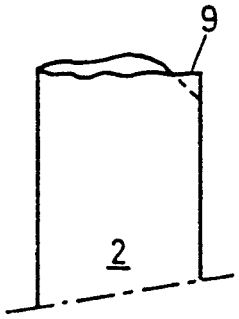
FIG. 4 is a perspective view of the embodiment shown in FIG. 1, illustrated in an open state.

The flat packaging bag 1 illustrated in FIGS. 1, 2 and 3 essentially comprises a longitudinally folded packaging wrapper having an upper side (sheet panel) 2, a folded edge 3 and a lower side (sheet panel) 4. The longitudinal edges of the sides 2 and 4 are bonded to one another with a longitudinal seal 5 so that an elongated sleeve is formed in which a product such as powdered sugar or coffee may be accommodated. The two ends of the elongated sleeve may be closed by bonding together the edges of the small sides 2 and 4 with transverse seals 6 and 7, whereby an airtight package for the product is obtained. In the zone where the longitudinal seal 5 and the transverse seal 7 intersect, the transverse seal 7 has an enlargement 8 in which a tear-open slit 9 is provided that cuts through a number of wrapper sheet layers. The tear-open slit 9 may be a simple cut, effected by a single blade, without removal of material. Preferably, the distance between the slit 9 and the outer edge 10 of the small side of the sleeve where the transverse seal 7 is located is slightly greater than the normal (that is, non-enlarged) width of the transverse seal 7. The slit 9 does not penetrate far across the width of the longitudinal seal 5 so as to ensure that the hermetic seal of the package is not endangered. The tear-open slit 9 aids in initiating the tearing of the end of the sleeve such that the user may with ease produce a tear which extends parallel to the transverse seal 7 and results in a full severance of an end portion of the sleeve where the transverse seal 7 and the tear-open slit 9 are provided.

Figure 5:
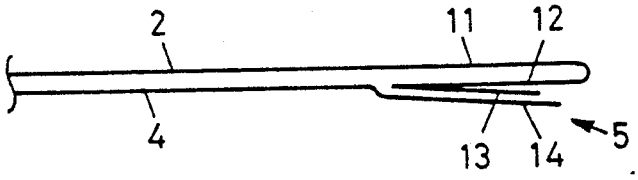
FIG. 5 is a sectional side elevational view of a variant of the embodiment shown in FIGS. 1–4, having an outwardly-folded longitudinal fin seal.
Figure 6:
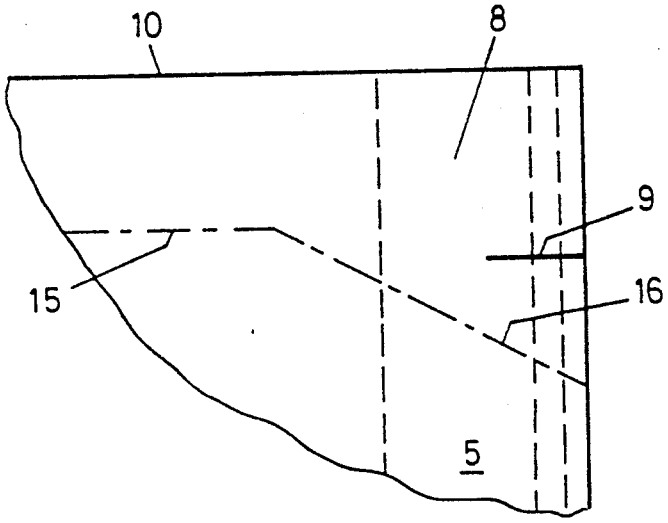
FIG. 6 is a top plan view of the embodiment illustrated in FIG. 5 including a short tear-open slit in an enlargement of a transverse seal according to a first variant.

As shown in FIG. 5, the longitudinal seal 5 may be a fin seal wherein one sheet wrapper layer 11 is situated at the sleeve side 2 and three wrapper sheet layers 12, 13 and 14 are situated on the sleeve side 4. The tear-open slit 9, as shown in FIG. 6, cuts through all four layers 11–14. The sheet panel 2 has a marginal longitudinal zone 13 and the sheet panel 4 has a marginal longitudinal zone 14. The zones 13 and 14 form flaps. In FIG. 6, the enlargement 8 of the transverse seal 7 is bounded by a straight line 16 which forms an obtuse angle with the inner border line 15 of the transverse seal 7. The line 15 extends parallel to the outer edge 10. In this variant the tear-open slit 9 is relatively short since it is provided only in the longitudinal seal 5.

Figure 7:
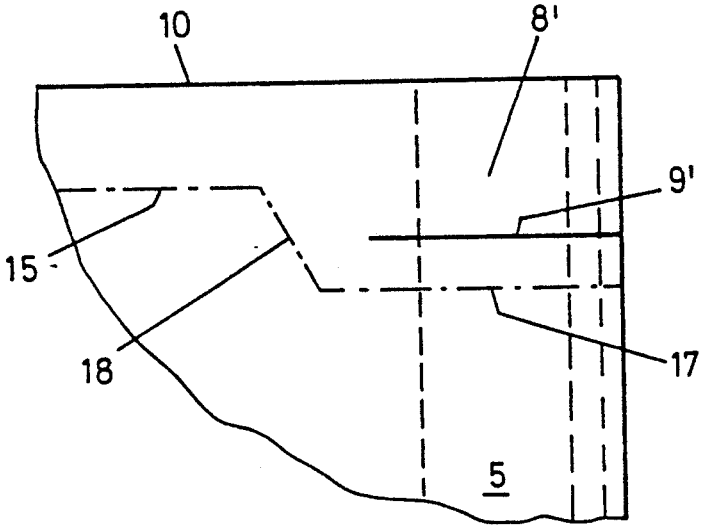
FIG. 7 is a top plan view of the embodiment shown in FIG. 5 having a long tear-open slit in an enlargement of a transverse seal according to a second variant.

In the variant shown in FIG. 7 which has a greater enlargement 8' than the FIG. 6 embodiment, the enlargement 8' is bounded by a straight line 18 which, similarly to the line 16 of the FIG. 6 embodiment, extends obliquely from the line 15, and a line 17 which adjoins line 18 and which is offset parallel to line 15. In this variant the tear-open slit 9' is relatively long: it extends throughout the entire width of the longitudinal seal 5 and even extends into but does not project beyond, the enlargement 8'.

Figure 8:
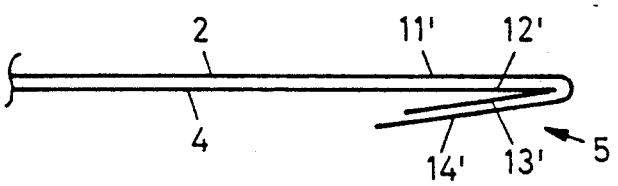
FIG. 8 is a cross-sectional view of another preferred embodiment of the invention having an inwardly folded longitudinal fin seal.
Figure 9:
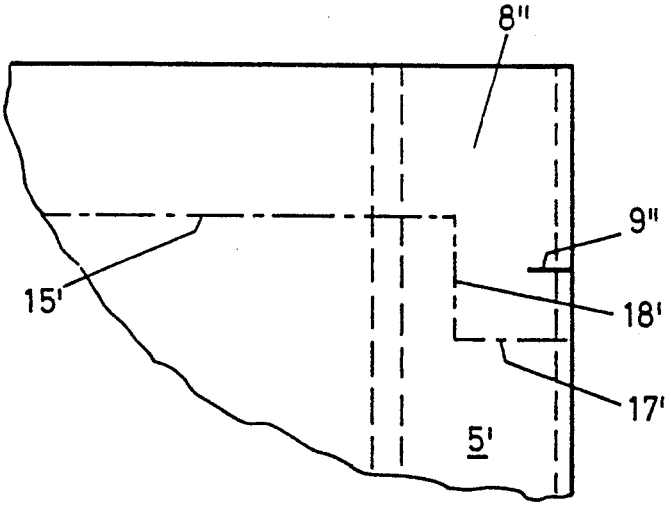
FIG. 9 is a top plan view of the embodiment shown in FIG. 8, including a short tear-open slit in an enlarged portion of a transverse seal.

In the embodiment according to FIG. 5, the longitudinal fin seal is folded outwardly, that is, towards the adjoining edge of the package. According to the invention, as shown in FIG. 8, the fin seal may also have an inward orientation. The longitudinal seal 5 as shown in FIG. 8 has a wrapper layer 11' on the sleeve side 2 and three wrapper layers 12', 13' and 14' on the sleeve side 4. Layers 13' and 14' constitute marginal longitudinal zones (flap). In this construction the tear-open slit 9'', as illustrated in FIG. 9, passes through the four layers 11'–14'. In FIG. 9, the enlargement 8'' is bounded by a line portion 17' which is parallel and offset relative to the inner seal edge 15' and a connecting line 18' which is perpendicular to the lines 15' and 17'. The tear-open slit 9'' is relatively short: it extends only partially through the width of the longitudinal seal 5', taking into account the fact that the enlargement 8'' is relatively narrow. It is also feasible to utilize, in the embodiment according to FIG. 8, the variants according to FIGS. 6 and 7 or to modify the embodiment of FIG. 5 with the variant shown in FIG. 9.

In FIGS. 5 and 8, the outer flaps 14 and 14' are somewhat shorter than the respective inner flaps 13 and 13', to facilitate a securement of the outer flaps to the outer wall of the bag.

Figure 10:
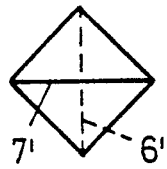
FIGS. 10, 11 and 12 are three further embodiments having transverse seals in perpendicularly oriented planes.
Figure 11:
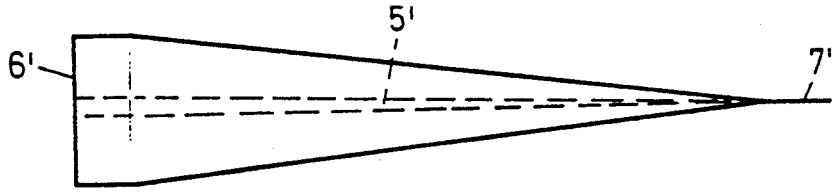
Figure 12:
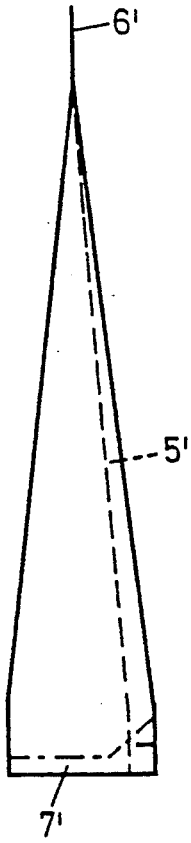

The packaging bag according to FIGS. 10, 11 and 12 has a longitudinal seal 5' and two transverse seals 6' and 7' which correspond to the respective seals 5, 6 and 7 in the embodiments illustrated in FIGS. 1–9 and 13–16. The transverse seals 6' and 7' are, however, bonding together adjoining sheets which are at a mutually perpendicular plane to one another, whereby a packaging bag is obtained which is not flat as in the other embodiments but has the shape of an elongated tetrahedron with rounded edges. Such a bag has an increased volume.

The sleeve of the packaging bag according to FIGS. 10, 11 and 12 may be made with the same process as the sleeve according to FIGS. 1, 2 and 3. Such a process may comprise these steps: a wrapper sheet is pulled over a shaping device whereby the sheet is longitudinally bent to form a sleeve and then two adjoining longitudinal sheet edges are bonded to one another with a longitudinal seal 5. Thereafter, the tubular member formed in such a manner is advanced and is, at predetermined locations, pinched together and is further provided with a transverse seal and with a tear-open slit. Then the leading bag is severed by a cutting device in such a manner that the trailing bag opening is guided underneath a product dispensing device which charges the bag with the product whereupon the open side through which the filling has taken place is closed with a second transverse seal. It is further feasible to provide later a second tear-open slit in the second transverse seal.

The longitudinal seal 5, as shown in FIG. 13, may be an overlap seal wherein a flap (marginal longitudinal zone) 22 of the sheet panel 20 is situated between a portion 21 of the sheet panel 20 and a flap 23 of the other sheet panel 20. In this case the tear-open strip 29 or 29'—as shown in FIGS. 15 and 16, respectively—cuts through a total of three layers 21, 22 and 23. As shown in FIG. 14, the longitudinal seal 5 may be an overlap seal bonding two wrapper sheet panels 30 and 30' and together. A flap 23' of the panel 30 is folded directly onto a portion 21' of the panel 30 and a flap (marginal longitudinal zone) 22' of the panel 30'is situated on the flap 23'. In such case, the tear-open slit 29 or 29' as shown in FIG. 15 or 16 cuts trough three sheet layers 21', 22' and 23'. FIG. 15 shows an enlargement 28 which is bounded by an oblique line 33 extending from the end of lien 31 (delimiting the transverse seal) and a line 32 offset parallel to the line 31. In this variant, the tear-open slit 29 is relatively short: it extends solely in the zone of the longitudinal seal 5.

The embodiment shown in FIG. 16 is similar to the structure of FIG. 15, but the enlargement 28' is of greater area by virtue of the fact that the line 32' is longer than the corresponding line 32 in FIG. 15, and thus the connecting oblique line 33' corresponding to line 33 of the FIG. 15 embodiment is shifted in a direction away from the longitudinal seal 5. In this embodiment the tear-open slit 29' is relatively long: it extends throughout the entire width of the longitudinal seal 5 and even projects into yet does not extend beyond the enlargement 28'.

It is noted that each embodiment according to one of FIGS. 5, 8, 13 or 14 is combinable with any variant according to one of FIGS. 6, 7, 9, 15 or 16 to obtain a package of the type according to FIGS. 1, 2 and 3 or a package type according to FIGS. 10, 11 and 12.

It is an advantage of the packaging bag according to the invention that the tear-open slit applied according to the invention avoids the use of additional materials and ensures a user friendly tear-open aid for bags having longitudinal and transverse seals having a plurality of bonded layers. "User friendly" in this connection means that even wrapper sheets which can be torn manually only with difficulty such as those made of polyester, polypropylene or oriented polypropylene, may be readily torn with the application of only a slight manual force and further, the obtained open cross section is large. When the tear-open slit according to the invention is used, the bag may be torn open over 50% of its width. This is of particular importance in relatively narrow elongated bags which have a length-to-width ratio of, for example, 5:1 or even in normal bags which contain only poorly pourable material such as powdered soup.

In FIGS. 6, 7, 9, 15 and 16 the tear-open slit 9, 9', 9'', 29, or 29'' extends perpendicularly to the edge of the longitudinal seal 5. As shown in FIG. 17, in a packaging bag of the various types described above, it is feasible to provide a tear-open slit 39 at an oblique angle to the length of the longitudinal seal 5 so that in such a case it may not be necessary to provide the tear-open slit in the zone of an enlargement 8, 8', 8'' 28 or 28' of the transverse seal 7.

Preferably, in the packaging bag according to the invention the minimal distance between the tear-open slit 9, 9', 9'', 29, 29' or 39 and the inner space of the package should be at least 2 mm to ensure a continued hermetic seal of the package.

It will be understood that the above description of the present invention is susceptible to various modifications, changes and adaptations, and the same are intended to be comprehended within the meaning and range of equivalents of the appended claims.

What is claimed is:

1. A packaging bag having opposite bag sides and being delimited by first and second opposite longitudinal edges and first and second opposite transverse edges; the packaging bag comprising:

(a) two superposed sheet panels forming said opposite sides of said bag;

(b) a first fold interconnecting said sheet panels and constituting said first longitudinal edge;

(c) a second fold provided in at least one of said sheet panels and constituting said second longitudinal edge;

(d) a first and second flap constituted by a marginal longitudinal zone of said first and second sheet panels, respectively; said first and second flaps extending along said second longitudinal edge; at least one of said flaps being folded onto one of said bag sides;

(e) a longitudinal seal bonding together the superposed sheet panels along said second longitudinal edge;

(f) first and second transverse seals bonding together the superposed sheet panels along said first and second transverse edges, respectively; said first and second transverse seals intersecting said longitudinal seal to form zones of intersection therewith; and (g) a tear-open slit provided in at least one of said zones of intersection and passing through said first and second flaps and at least one of said first and second sheet panels.

2. A packaging bag as defined in claim 1, wherein said first and second flaps are superposed and folded onto one of the bag sides; one of the flaps being an inner flap and the other of the flaps being an outer flap; said outer flap projecting beyond said inner flap.

3. A packaging bag as defined in claim 1, wherein said first and second flaps are superposed and folded onto one of the bag sides; said first and second flaps having free edges oriented towards said second longitudinal edge.

4. A packaging bag as defined in claim 1, wherein said first and second flaps are superposed and folded onto one of the bag sides; said first and second flaps having free edges oriented away from said second longitudinal edge.

5. A packaging bag as defined in claim 1, wherein said longitudinal seal is a fin seal and further wherein said tear-open slit passes through said sheet panels and said first and second flaps.

6. A packaging bag as defined in claim 1, wherein said longitudinal seal and said transverse seals define a hermetically sealed inner volume of said bag; a spacing between said tear-open slit and said inner volume being at least 2 mm.

7. A packaging bag as defined in claim 1, one of said transverse seals having an enlarged area extending into said longitudinal seal i the zone of intersection.

8. A packaging bag as defined in claim 7, wherein said tear-open slit extends into said enlarged area.

9. A packaging bag as defined in claim 1, wherein said tear-open slit extends perpendicularly to said longitudinal seal.

10. A packaging bag as defined in claim 1, wherein said tear-open slit extends at an oblique angle to said longitudinal seal.

11. A packaging bag as defined in claim 1, wherein said tear-open slit is constituted by a cut without removal of material.

12. A packaging bag made of sheet material and having a length, a width, a longitudinal edge and a transverse edge; comprising (a) a longitudinal fin seal being situated at said longitudinal edge and extending parallel to said length; said longitudinal seal bonding together two panels of sheet material; said longitudinal fin seal having a flap folded onto a bag side; said flap having an inner sheet and an outer sheet; said outer sheet projecting beyond said inner sheet;

(b) two transverse seals extending parallel to said width and intersecting said longitudinal seal; each said transverse seal bonding together the two panels; and (c) a tear-open slit provided in said longitudinal fin seal and passing through the two panels, the inner sheet and the outer sheet.

* * * * *